United States Patent [19]

Sorensen

[11] 4,146,226

[45] Mar. 27, 1979

[54] RAZOR TYPE ARROWHEAD

[76] Inventor: David L. Sorensen, 1404 Diana, Madison Heights, Mich. 48076

[21] Appl. No.: 784,139

[22] Filed: Apr. 4, 1977

[51] Int. Cl.[2] ..... F41B 5/02

[52] U.S. Cl. ..... 273/106.5 B; 30/337

[58] Field of Search ..... 273/106.5 B; 30/337

[56] References Cited

U.S. PATENT DOCUMENTS

| | | | |
|---|---|---|---|
| 493,075 | 3/1893 | Evertz | 30/337 X |
| 1,484,657 | 2/1924 | Larzelere | 30/337 |
| 2,350,581 | 6/1944 | Boose | 273/106.5 B |
| 3,915,455 | 10/1975 | Savora | 273/106.5 B |
| 4,006,901 | 2/1977 | Simo | 273/106.5 |
| 4,036,499 | 7/1977 | Sherwin | 273/106.5 B |

*Primary Examiner*—Paul E. Shapiro
*Attorney, Agent, or Firm*—Robert G. Mentag

[57] ABSTRACT

A razor type arrowhead having an elongated tubular body, with a plurality of longitudinal slots formed in spaced positions around the periphery of the body. A removable blade is mounted in each slot in the body. Each blade is provided with a dovetail connector extension that is seated in a mating recess in the body. A combination arrow shaft attachment and blade retainer member is mounted on the rear end of the body and releasably secures the blades in the body. An arrowhead nose member is releasably mounted on the front end of the body and is detachably connected to the combination arrow shaft attachment and blade retainer member.

10 Claims, 10 Drawing Figures

RAZOR TYPE ARROWHEAD

BACKGROUND OF THE INVENTION

1. Field of the Invention

This invention relates to arrowheads adapted for hunting, and which include a plurality of razor type blades that are releasably secured to an elongated arrowhead body.

2. Description of the Prior Art

It is well known in the arrowhead art to provide arrowheads with removable razor type blades. For example, U.S. Pat. No. 2,940,758 discloses an arrowhead in which a plurality of razor type blades are detachably mounted in slots extending longitudinally of the arrowhead body. However, a disadvantage of the arrowhead illustrated in said patent is that it is difficult to quickly exchange the blades, because they have retainer lips on the front and rear ends thereof which must be engaged with a retainer nose and an adaptor member, respectively. It is difficult to hold the blades in their grooves and, simultaneously, try to attach the two connecting members.

SUMMARY OF THE INVENTION

This invention relates to arrowhead structures, and in particular, to arrowheads which may be interchangeably assembled upon a given shaft, and which are provided with a plurality of removably mounted razor type blades.

It is an object of the present invention to provide an arrowhead construction which permits various types of arrowheads, with various types of razor type blades, to be interchangeably affixed to a given arrow shaft.

It is a further object of the invention to provide an arrowhead comprising a number of components which may be quickly and easily assembled and disassembled, whereby components which are damaged may be quickly and easily replaced.

It is still another object of the present invention to provide an arrowhead which may be quickly removed from an arrow shaft in the field for cleaning purposes.

It is still another object of the present invention to provide a razor type arrowhead having an elongated tubular body, and with a plurality of longitudinal slots in each of which is removably mounted a razor type blade. Each of the blades is provided with a dovetail connector member that is seated in a mating recess in the body. A combination arrow shaft attachment and blade retainer member is mounted on the rear end of the body and releasably secures the blades in the body. An arrowhead nose member is releasably mounted on the front end of the body and it is detachably connected to the combination arrow shaft attachment and blade retainer member.

Other objects, features and advantages of the invention will be apparent from the following detailed description, appended claims, and the accompanying drawings.

DESCRIPTION OF THE PREFERRED EMBODIMENTS

Figure 2:
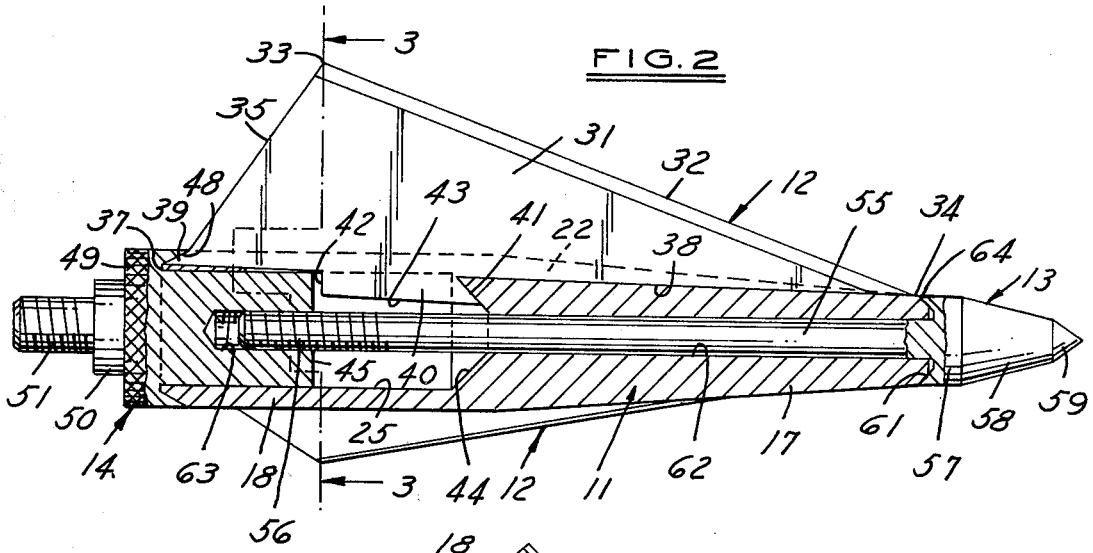
FIG. 2 is a longitudinal, side elevation view, with parts in section and parts broken away, of said first arrowhead embodiment illustrated in FIG. 3, taken along the line 2—2 thereof, and looking in the direction of the arrows.
Figure 1:
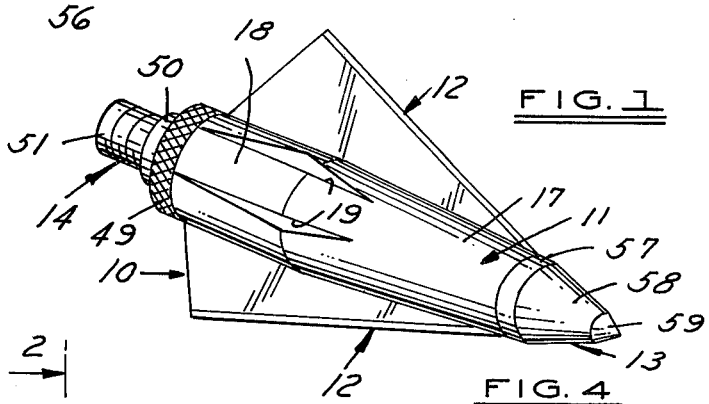
FIG. 1 is a perspective view of a first arrowhead embodiment made in accordance with the principles of the present invention.

Referring now to the drawings, and in particular to FIGS. 1 and 2, the numeral 10 generally designates an arrowhead made in accordance with the principles of the present invention. The numeral 11 generally designates an elongated tubular arrowhead body 11 on which is detachably mounted three razor type blades, which are each generally indicated by the numeral 12. The arrowhead 10 further includes a detachably mounted nose member, generally indicated by the numeral 13, and a combination arrow shaft attachment and arrow blade retainer member, generally indicated by the numeral 14. All the parts of the arrowhead 10 are preferably made from a suitable metal, as steel.

Figure 3:
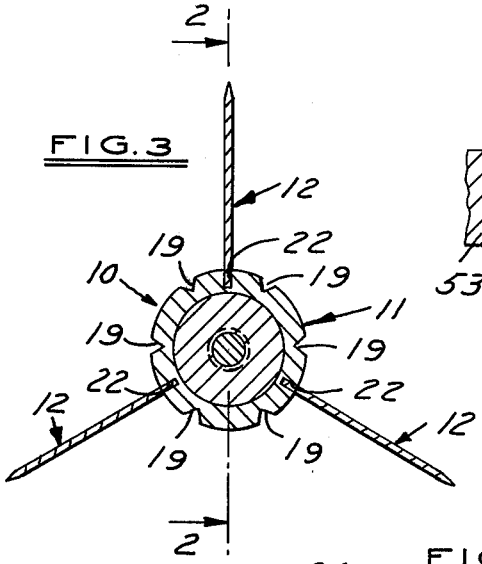
FIG. 3 is an elevation section view of the arrowhead structure illustrated in FIG. 2, taken along the line 3—3 thereof, and looking in the direction of the arrows.

The arrowhead body 11 comprises an elongated tubular body which includes a conically shaped forward end 17 and an integral rear cylindrical portion 18. As best seen in FIGS. 1 and 3, the arrowhead body 11 is provided with a plurality of elongated V-shaped blood slots 19 which are spaced around the periphery thereof, and which insure deep penetration and a quick kill when using the arrowhead 10. For example, if the arrowhead 10 is embedded in a body of an animal, the grooves 19 permit blood to quickly and easily flow from the body of the animal.

Figure 6:
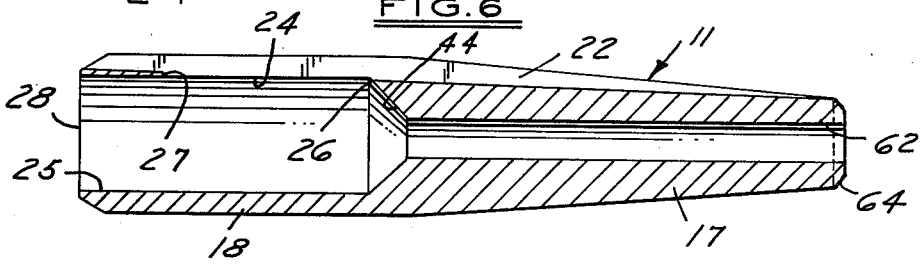
FIG. 6 is a longitudinal elevation section view of the arrowhead body employed in the arrowhead embodiment of FIGS. 1-3.

As shown in FIGS. 2, 3 and 6, the arrowhead body 11 is provided with three longitudinally extended grooves 22 which are evenly spaced around the body 11 for the reception of three of the blades 12. It will be understood that any plurality or number of blades 12 may be employed as, for example, three, five and so forth. The slots 22 extend for the length of the body 11.

As best seen in FIG. 6, the arrow body 11 is provided with an axial bore 25 which extends inwardly from the rear end thereof for approximately one-third of the length thereof. Each of the elongated slots 22 communicates with the bore 25 through an opening 24. As shown in FIG. 6, the front end of each of the openings or communication slots 24 is indicated by the numeral 26 and the rear end thereof by the numeral 27. The numeral 28 designates the rear end of the arrowhead body 11 at which point the bore 25 commences.

As shown in FIG. 2, each of the razor type blades 12 includes a triangularly shaped body 31 which is provided with a sharp razor type edge 32 along the outer elongated edge thereof. The cutting edge 32 slopes inwardly from its rear end 33 to the front end 34 adjacent the nose member 13. The rear end of the blade body 35 tapers or converges rearwardly at an acute angle from the point 33 toward the arrowhead body 11, and the inner end portion thereof continues at a different acute angle to provide an integral rear retaining lip 39 which is engaged by the combination arrow shaft attachment and blade retainer member 14, as described more fully hereinafter.

Each of the blade bodies 31 is provided with a radially inward extended dovetail connector member or extension 40 which extends inwardly through the adjacent opening or slot 24 into the bore 25 in the body 11. The dovetail connector member 40 extends radially inward of the arrowhead body 11 beyond the longitudinal inner bottom edge 38 of the blade body 31. The blade body bottom edge 38 is seated on the inner end surface of its respective elongated longitudinal slot 22. As shown in FIG. 2, the extension connector members 40 on each of the blade bodies 31 is provided with an angled front face, indicated by the numeral 41, which forms an acute angle with the bottom edge 38 of the blade body 31. The angled front end 41 forms a dovetail angle for seating on the conical inner end surface 44 of the axial bore 25, for seating engagement therewith to hold the respective arrow blade 12 in position in its respective slot 22. The longitudinal inner edge of each of the dovetail connector members 40 is indicated by the numeral 43, and the rear end thereof, as indicated by the numeral 42, is formed perpendicular to the longitudinal axis of the arrow head body 11 when each of the blades 12 is seated in its respective slot 22.

Figure 4:
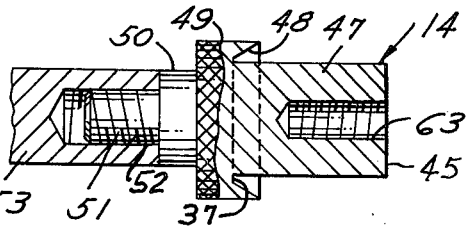
FIG. 4 is an elevation view, partly in section, of the combination arrow shaft attachment and blade retainer member employed in the arrowhead illustrated in FIGS. 1-3.

As best seen in FIG. 4, the combination arrow shaft attachment and blade retainer member 14 includes a cylindrical body 47 which is adapted to be slidably mounted into the bore 25 at the rear end of the arrowhead body 11. The shaft attachment and blade retainer member 14 is provided with an enlarged annular rib or head portion 49 which may be knurled on the outer surface thereof for gripping purposes. The head portion 49 is provided on the front end thereof with an undercut recess which is conically shaped around the outer portion thereof, as indicated by the numeral 48, and which terminates in a transverse end surface portion 37. The surface of the recess 48 tapers inwardly toward the longitudinal axis of the shaft attachment and blade retainer member 14. The front end of the shaft attachment and blade retainer member 14 is formed transverse or perpendicular to its longitudinal axis. The shaft attachment and blade retainer member 14 further includes an integral cylindrical shaft portion 50 which has integrally formed on its rear end a reduced diameter threaded shaft 51. As shown in FIG. 4, the shaft 51 is adapted to be threadably mounted in a threaded bore 52 on the front end of a conventional arrow shaft 53.

Figure 5:
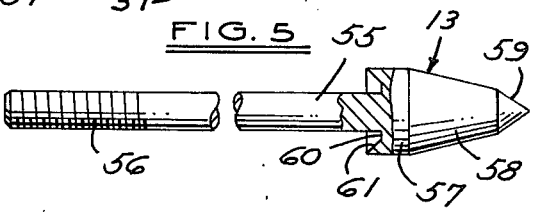
FIG. 5 is a side elevation view, partly in section, of the conical nose employed in the arrowhead embodiment of FIGS. 1-3.

As shown in FIG. 5, the arrowhead nose member 13 includes an elongated shaft 55 which has a threaded portion 56 formed on the rear end thereof. A cylindrical nose portion 57 is integrally attached to the front end of the shaft 55. A truncated nose portion 58 is integrally formed on the front end of the cylindrical portion 57, and a conical tip 59 is integrally formed on the front end of the nose portion 58. It will be seen that the tip portion 59 is formed to a different conical shape than the conical shape of the nose portion 58. However, any desired shape may be employed for the nose portion 57, 58 and 59. The cylindrical nose portion 57 has a conically shaped recess 61 formed in the rear transverse face thereof, and it terminates at its inner end in a transverse inner end surface 60.

In use, a blade 12 would be slidably mounted in each of the slots 22 with the dovetail connector member 40 moved radially inward through the adjacent slot 24. Each of the blades 12 is then individually moved forward to engage the dovetail connector sloping forward edge 41 against the conically shaped inner end surface 44 of the bore 25. The blades 12 are then releasably secured to the body 11 by slidably mounting the shaft attachment and blade retainer member body 47 in the bore 25 in the body 11. The nose member 13 is then mounted in the body 11 by extending the shaft 55 into the axial bore 62 which is formed through the body portion 17, and which communicates with the bore 25. The nose member shaft threaded portion 56 is threadably received in a threaded axial bore 63 formed in the front end of the shaft attachment and blade retainer member body 47. It will be seen that by rotating the shaft attachment and blade retainer member 14 in the appropriate direction, that it may be tightened in position relative to the nose piece 13, and thus secure simultaneously all of the blades 12 in position on the body 11.

Figure 7:
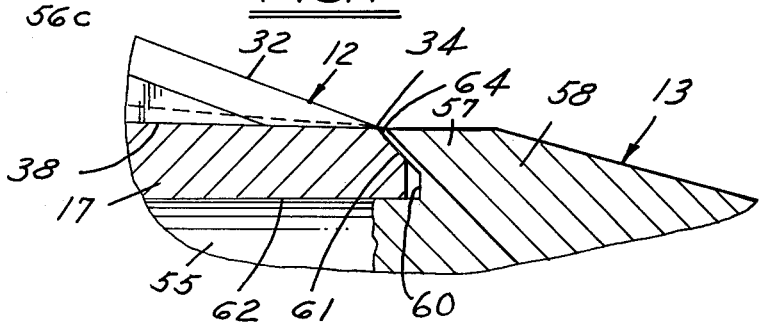
FIG. 7 is a fragmentary, enlarged view of the front end of the arrowhead structure shown in FIG. 2.

As shown in FIG. 7, when the shaft attachment and blade retainer member 14 is rotated to draw the nose member 13 into the body 11, the conical surface 61 of the recess formed in the rear end of the nose portion 57 seats on the conical or tapered edge 64 on the front end of the body 11, so as to provide a centering action to the nose member 13. It will be seen that the blades 12 in the embodiment of FIGS. 1 through 7 are retained in the body 11 by the co-action of the shaft attachment and blade retainer member 14 overlapping the retainer lip 39 on the rear end of each of the blades 12, and also wedging the blades 12 forwardly to firmly engage the front ends 41 of each of the dovetail connector members 40 against the conical surface 44 of the front end of the bore 25. The front end 34 of each of the blades 12 is not engaged by the nose member 13, as clearly shown by FIG. 7.

Figure 8:
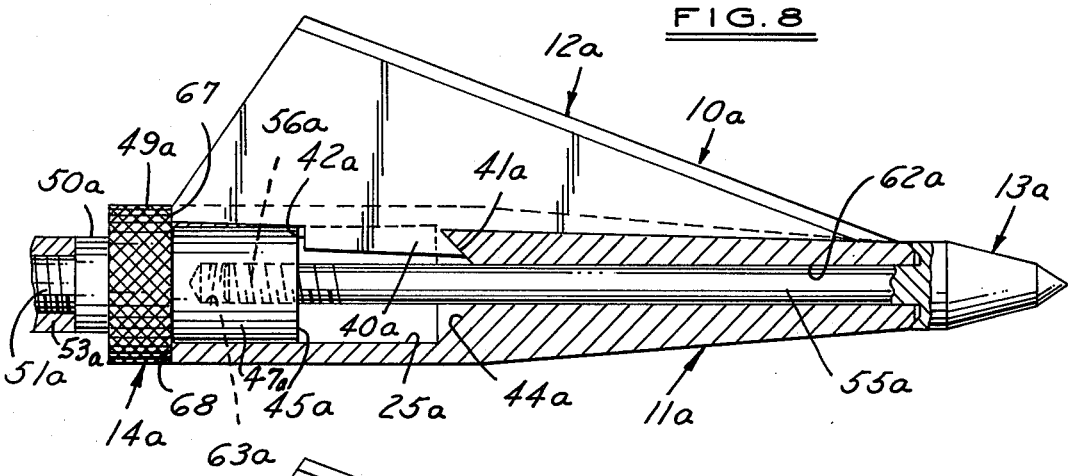
FIG. 8 is a longitudinal elevation view, partly in section, similar to the illustration of FIG. 2, and showing a second arrowhead embodiment of the invention.

FIG. 8 illustrates a second embodiment of the invention, and the parts thereof which are the same as the parts of the first embodiment of FIGS. 1 through 7, have been marked with the same reference numerals, followed by the small letter "a". In the embodiment of FIG. 8, the retainer lip 39 on the rear end of each of the blades **12*a* has been eliminated, and in lieu thereof, a transverse face portion 68 is formed on the rear end of each of the blades 12*a*. The front face 67 of the enlarged annular portion 49*a* of the shaft attachment and blade retainer member is formed perpendicular or transverse to the longitudinal axis of the arrowhead body 11. Accordingly, it is seen that when the shaft attachment and blade retainer member 14*a* is screwed inwardly onto the threaded shaft end 56*a* of the shaft 55*a*, the front face 67 on the retainer member 14*a* will engage the flat rear end faces 68 on each of the blades 12*a* and bias the blades forwardly into gripping engagement between the front ends 41*a* of the dovetail connector members 48*a* and the inner face 44*a* of the recess 25*a*, for holding the blades 12*a* firmly in position on the body 11*a***.

Figure 9:
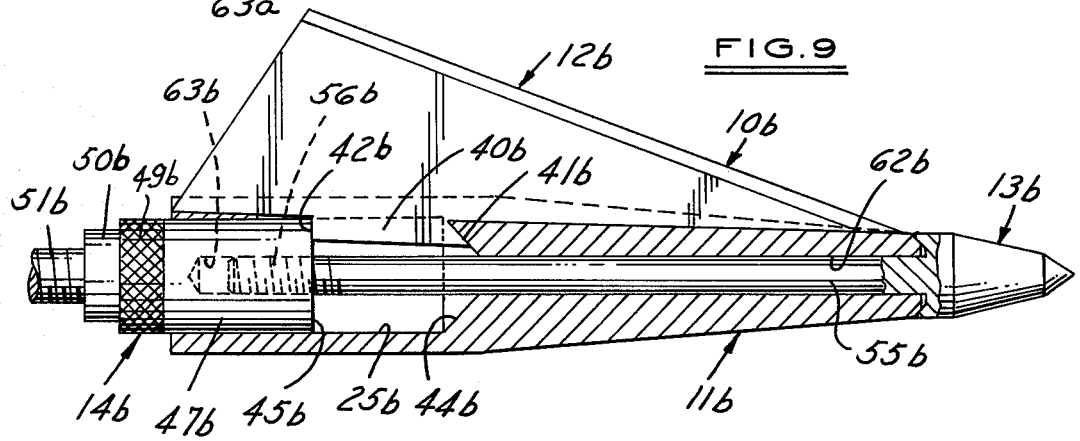
FIG. 9 is a longitudinal elevation view, partly in section, similar to the illustration of FIG. 2, and showing a third arrowhead embodiment of the invention.

FIG. 9 illustrates a third embodiment of the invention, and the parts thereof which are the same as the parts of the first embodiment of FIGS. 1 through 7 are marked with the same reference numerals, followed by the small letter "b". In the embodiment of FIG. 9, the shaft attachment and blade retainer member 14b is not provided with an enlarged annular portion, but the corresponding part is marked with the numeral 49b, and it is formed to the same outer diameter as the body portion 47b. In the embodiment of FIG. 9, the blades 12b are biased fowardly into a firm seating engagement in the body 11b by the retainer body 47b being provided with a transverse face 45b which is formed perpendicularly to the longitudinal axis of the body 11b. The transverse face 45b on the retainer member body 47b engages the perpendicular rear ends 42b on each of the dovetail connector members 40b for biasing each of the blades 12b fowardly, with the dovetail connector members 40b seating against the surface 44b of the bore 25b.

Figure 10:
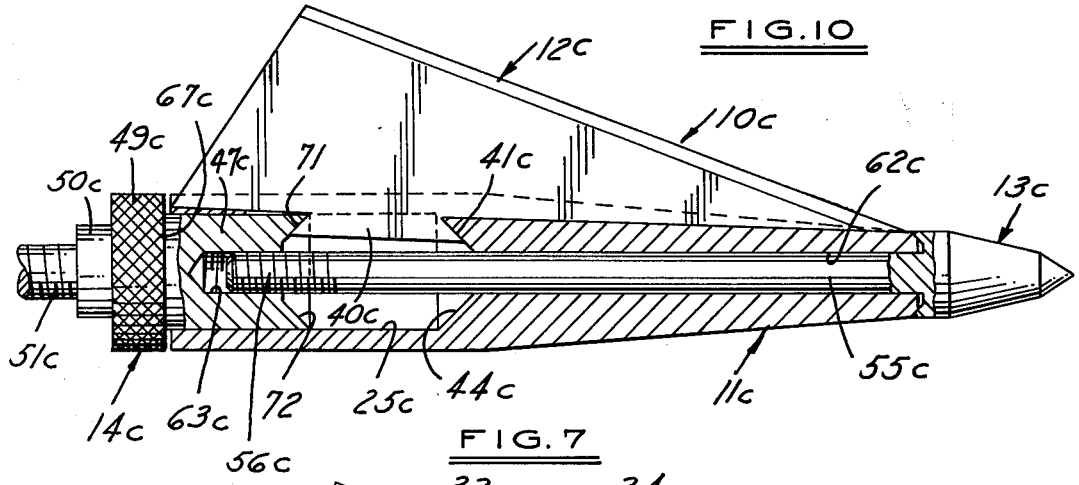
FIG. 10 is a longitudinal elevation view, partly in section, similar to the illustration of FIG. 2, and showing a fourth arrowhead embodiment of the invention.

FIG. 10 illustrates a fourth embodiment of the invention wherein the parts that are the same as the parts in the first embodiment of FIGS. 1 through 7 have been marked with the same reference numerals followed by the small letter "c". In the embodiment of FIG. 10, the shaft attachment and blade retainer member 14c is provided with a conical recess 72 formed in the inner end of the retainer member body 47c and which engages the rear angled surface ends 71 of each of the blades 12c, whereby when the retainer member 14c is threaded inwardly onto the shaft end 56c, the retainer body 47c cams each of the blades 12c forwardly into a locked position against the surface 44c of the forward end of the bore 25c.

While it will be apparent that the preferred embodiments of the invention herein disclosed are well calculated to fulfill the objects above stated, it will be appreciated that the invention is susceptible to modification, variation and change.

What is claimed is:

1. In an arrowhead assembly for attachment to an arrow shaft, the combination comprising:

(a) an elongated tubular body having a front end with a conical outer edge and a rear end, and having a plurality of longitudinal slots formed in spaced positions around the periphery thereof, with the front ends of the slots terminating at the rear end of said front end conical outer edge;

(b) a removable blade mounted in each slot in said body with each of said blades being provided with a radially inward extended portion that engages said body for holding the blades in said slots against forward and radial movements relative to the body, and the front end of each blade terminating at the front end of its slot;

(c) an arrowhead nose member mounted on the front end of the body and having a conical recess formed in the rear end thereof for seating engagement with the conical edge on said tubular body without engaging said blades;

(d) means engageable with the blades for retaining the blades in said slots against rearward movement relative to the body and being releasably connected to said arrowhead nose member;

(e) arrow shaft attachment means, carried by said means engageable with the blades, for attaching the arrowhead to an arrow shaft; and, (f) each of said slots including a radially inward extended slot portion that receives the radially inward extended portion of a blade in each slot.

2. An arrowhead assembly, as defined in claim 1, wherein:

(a) each of said blades is a razor type blade.

3. An arrowhead assembly, as defined in claim 1, wherein:

(a) the inwardly extended portion of each blade is provided with a forwardly extended portion that is releasably engaged with said body.

4. An arrowhead assembly as defined in claim 3, wherein:

(a) said means for retaining the blades against rearward movement relative to the body is engageable with the rear ends of said blades.

5. An arrowhead assembly as defined in claim 4, wherein:

(a) each of said blades is provided with a retaining lip on the rear end thereof for engagement by said means for retaining the blades against rearward movement.

6. An arrowhead assembly as defined in claim 4, wherein:

(a) each of said blades is provided with a transverse surface on the rear end thereof for engagement by said means for retaining the blades against rearward movement.

7. An arrowhead assembly as defined in claim 3, wherein:

(a) said means for retaining the blades against rearward movement relative to the body is engageable with said inwardly extended portion on each of said blades.

8. An arrowhead assembly as defined in claim 7, wherein:

(a) each of said inwardly extended blade portions is provided with a transverse surface on the rear end thereof for engagement by said means for retaining the blades against rearward movement.

9. An arrowhead assembly as defined in claim 3, wherein:

(a) said means for attaching the arrowhead to an arrow shaft is integral with said means for retaining the blades against rearward movement.

10. In an arrowhead assembly for attachment to an arrow shaft, the combination comprising:

(a) an elongated tubular body having a plurality of longitudinal slots formed in spaced positions around the periphery thereof;

(b) a removable blade mounted in each slot in said body with each of said blades being provided with an inwardly extended portion that engages said body for holding the blades in said slots against forward and radial movements relative to the body;

(c) an arrowhead nose member mounted on the front end of the body;

(d) means engageable with the blades for retaining the blades in said slots against rearward movement relative to the body and being releasably connected to said arrowhead nose member;

(e) arrow shaft attachment means, carried by said means engageable with the blades, for attaching the arrowhead to an arrow shaft;

(f) each of said slots including a radially inward extended portion that receives the inwardly extended portion of a blade;

(g) the inwardly extended portion of each blade being provided with a forwardly extended portion that is releasably engaged with said body;

(h) said means for retaining the blades against rearward movement relative to the body being engageable with said inwardly extended portion on each of said blades; and, (i) each of said inwardly extended blade portions being provided with a rearwardly extended portion for engagement by said means for retaining the blades against rearward movement.

* * * * *